US005330079A

United States Patent [19]

Keller

[11] Patent Number: 5,330,079

[45] Date of Patent: Jul. 19, 1994

[54] DISPENSING CARTRIDGE WITH REINFORCED RETAINING FLANGE

[76] Inventor: Wilheim A. Keller, Obstgartenweg 9, CH-6402 Merlischachen, Switzerland

[21] Appl. No.: 91,295

[22] Filed: Jul. 15, 1993

[30] Foreign Application Priority Data

Jul. 17, 1992 [EP] European Pat. Off. ..... 92810546.9

[51] Int. Cl.[5] ..... B67D 5/52

[52] U.S. Cl. ..... 222/135; 222/137; 222/326

[58] Field of Search ..... 222/137, 145, 135, 325–327, 222/386, 389

[56] References Cited

U.S. PATENT DOCUMENTS

| | | | |
|---|---|---|---|
| 3,212,685 | 10/1965 | Swan et al. | 222/386 |
| 3,330,444 | 7/1967 | Raypholtz | 222/386 X |
| 4,231,494 | 11/1980 | Greenwood | 222/389 X |
| 4,273,270 | 6/1981 | Kray | 222/389 X |
| 4,426,024 | 1/1984 | Hogan et al. | 222/389 X |
| 4,634,027 | 1/1987 | Kanarvogel | 222/389 X |
| 4,874,368 | 10/1989 | Miller et al. | 222/137 X |
| 5,005,735 | 4/1991 | Keller | 222/327 |
| 5,228,599 | 7/1993 | Keller | 222/137 |

FOREIGN PATENT DOCUMENTS

| | | | |
|---|---|---|---|
| 291753 | 11/1988 | European Pat. Off. . | |
| 0452270 | 10/1991 | European Pat. Off. | 222/137 |

*Primary Examiner*—Kevin P. Shaver
*Attorney, Agent, or Firm*—Richard Linn

[57] ABSTRACT

A dispensing cartridge having a retaining flange connected to an end thereof, the retaining flange including at least two flat portions disposed in parallel planes, and a plurality of webs connecting the flat portions. The retaining flange is designed as a box construction with outwardly open hollow spaces having constant or increasing rectangular cross-sections in a direction perpendicular to the dispensing flow direction. The webs connecting the flat portions may be in two sets, with the webs in one set extending perpendicular to the webs in the other set. The retaining flange may be manufactured by injection molding. The box construction design of the flange requires only slightly more material than a single retaining flange, yet provides a gain in stability that allows simpler and more economical adapters of the dispensing appliances to be used.

14 Claims, 2 Drawing Sheets

DISPENSING CARTRIDGE WITH REINFORCED RETAINING FLANGE

BACKGROUND OF THE INVENTION

The present invention relates to dispensing cartridges for flowable substances.

Dispensing cartridges, in particular for two or more components, are increasingly used in areas where only small quantities are required or in conditions of very limited space. As examples, dispensing cartridges may be used in the repair of electric or electronic apparatus and do-it-yourself applications. The cartridges are typically made of synthetic materials and are preferably manufactured by injection-molding.

One type of known dispensing appliance is characterized in that the cartridges are not seized by their collar, i.e. not near the dispensing nozzle. When maintained by the collar, the pressure applied by the dispensing piston is directly taken up by the retainer of the dispensing appliance. Instead, the dispensing appliance retains the cartridges by a flange at the bottom, i.e. at the end opposite the dispensing opening of the cartridge. This is advantageous in that only the cartridge itself enters into the area of application. It is thus possible to dispense a flowable substance even to hardly accessible locations.

As the cartridge of these dispensing appliances is only retained at the bottom, and since the pressure applied to the cartridge body by the dispensing piston must consequently be transmitted from the tip to the holding flange and from there to the dispensing appliance, the cartridge itself, and particularly its holding flange, must be correspondingly sturdy. In the case of multiple component substances which are only mixed in an attached mixing tube at the time of dispensing, or with high-viscosity substances, considerable forces are generated even in relatively small cartridges having capacities in the milliliter range. These problems are additionally aggravated by the fact that also for reasons of environmental protection, smaller cartridges with a minimal mixing volume, and thus, with a smaller overall residual volume are desired. However, such cartridges require greater pressures for dispensing due to the smaller cross-section of the attached mixing tube. The cartridge bodies can be adapted to these increased requirements by a reinforcement of the walls. The retaining flange, in contrast, tends to bend, to break loose or to slip out from the adapter of the retaining device.

Hitherto it has been common practice to ensure transmission of forces from the dispensing appliance to the cartridges by as complete a retention of the retaining flange as possible on all sides, and more particularly, close to the cylindrical cartridge bodies. However, these dispensing appliances are expensive and only applicable in a limited range of cartridge sizes. One of the characteristics of simpler and lower-priced dispensing appliances, as e.g. described in EP-B-0,291,753 to the applicant, is that the retaining flange at the bottom of the cartridge is not held completely, resulting in locally increased stresses of the latter. On the other hand, reinforcement of the retaining flange is limited by the preferred manufacturing technique of injection-molding, and its strengthening by this method would also lead to inacceptable costs as compared to the obtainable results.

Analogous problems appear with respect to dispensing appliances retaining the cartridge by the collar. In this case as well, the cartridges often require a reinforcement of the dispensing opening. Especially in the case of multiple component cartridges with mixing ratios greatly differing from 1:1, one of the cartridge bodies is very lean, and a strong collar in the form of a disk near the dispensing opening must be provided in order to create a good support for the adapter of the dispensing appliance. Here also, an incomplete retention by the dispensing appliance, in particular, may lead to deformations as described above, and thus to an unprecise dispensing and mixing process.

SUMMARY OF THE INVENTION

It is thus an object of the present invention to provide a cartridge having an improved transmission of the dispensing force to the cartridge holder.

This object is attained by a dispensing cartridge wherein the retaining flange is designed as a box construction which is composed of at least two flat portions and of webs connecting said portions. Preferred embodiments are defined in the remaining claims.

Accordingly, the retaining flange is composed of at least two flat portions which surround the cartridge body and which are interconnected by webs, thus resulting in a box-type construction. The latter is stable enough to resist even the dispensing forces of high-viscosity substances from larger dispensing cartridges, while it is possible for the flange to be only partly retained by the adapter of the dispensing appliance, e.g. on two or three sides.

The invention is further explained by the following detailed description of embodiments.

DETAILED DESCRIPTION OF THE INVENTION

Figure 2:
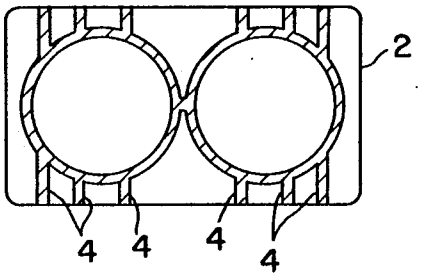
FIG. 2 shows a cross-section according to line II-II in FIG. 1.
Figure 4:
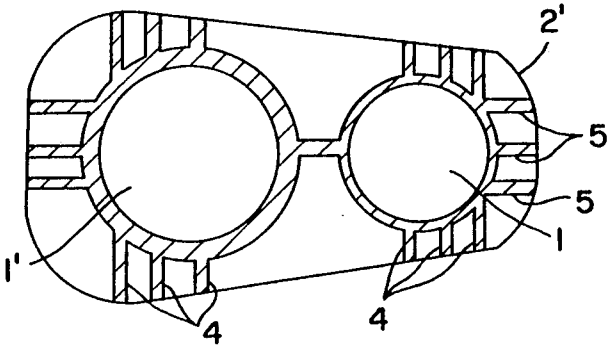
FIG. 4 show s a cross-section of a two-component cartridge having different size storage containers.
Figure 1:
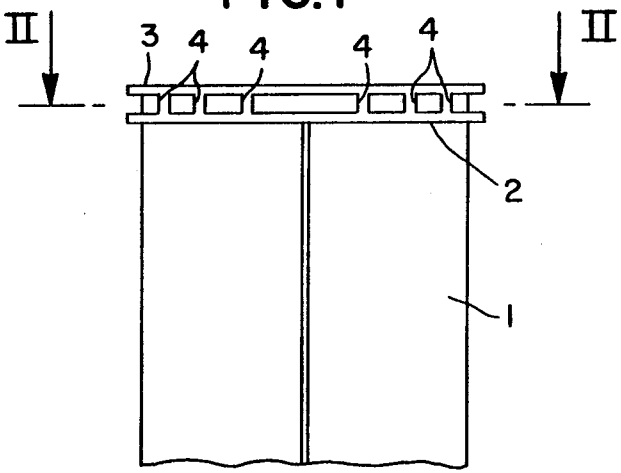
FIG. 1 shows a side elevation of a two-component cartridge.
Figure 3:
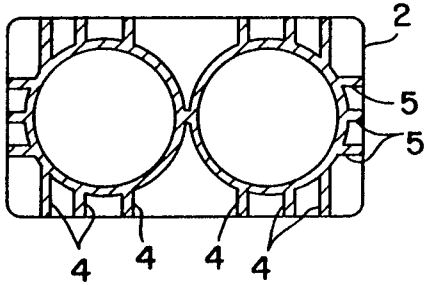
FIG. 3 shows a cross-section according to line II-II in FIG. 1 of a different embodiment.

The retaining flange of cartridge 1 consists of the two flat plate portions 2 and 3 which are traversed by the cartridge body. The flat plate portions may, e.g., have rectangular contours. The flat plate portions are interconnected by webs 4 and thus form a highly stable box structure. It is sufficient, for example, for the flange to be embraced by the adapter (not shown) of the dispensing appliance on the longitudinal sides only. In most cases, however, another holding device is provided on a third side, the holding device also retaining the retaining flange and serving as a stop when the cartridge is introduced into the adapter of the dispensing appliance. FIG. 3 shows a further reinforced embodiment wherein further webs 5 are present which extend at a right angle with respect to webs 4. FIG. 4 shows a further application to a cartridge having different size storage containers 1 and 1'.

Figure 5:
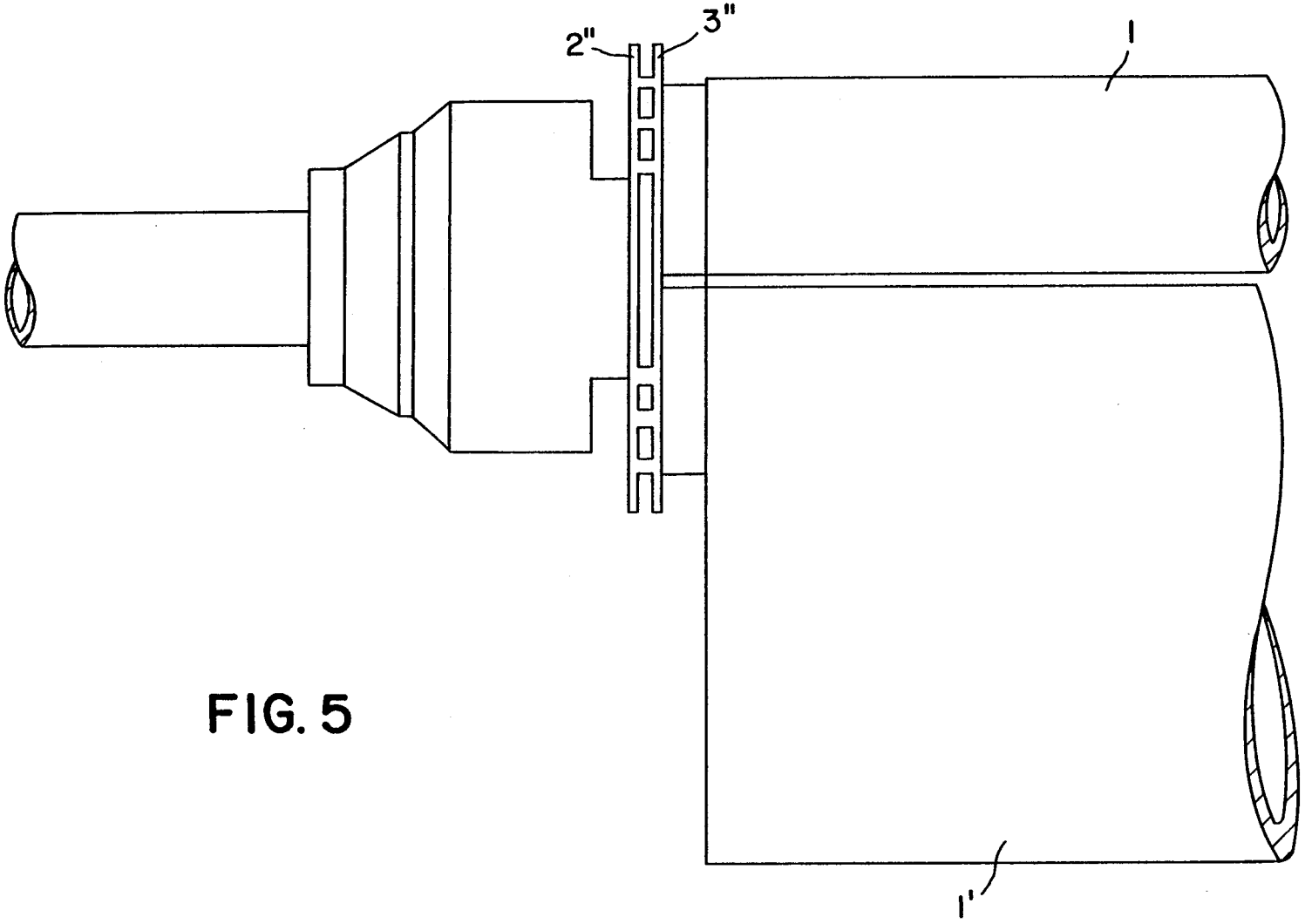
FIG. 5 shows a side elevation of a dispensing end of a two-component cartridge.

This configuration of the retaining flange requires only unsubstantially more material than a single flange and can be realized without any problems by current manufacturing techniques for dispensing cartridges. The flange of the invention transmits the forces applied during dispensing from the cartridge body to the holder without any deformations which would disturb the operation. The described design also avoids the shrinkage problems encountered in the injection-molding of large wall thicknesses. The same type of flange may also be provided at the dispensing end of a cartridge, as shown in FIG. 5.

Modifications of the cited examples are possible without leaving the scope of the invention. For example, dispensing cartridges for one, two or more components are conceivable, different constructions of retaining devices may be used, the cartridge cylinders may have different shapes, the webs may be differently arranged, and the retaining flange may have different contours.

I claim:

1. A dispensing cartridge, comprising:

a cartridge body having a longitudinal axis and a first end; and a retaining flange connected to said first end;

wherein said retaining flange comprises at least two flat plate portions disposed in parallel planes with respect to one another, and a plurality of webs connecting said flat plate portions.

2. The dispensing cartridge of claim 1, wherein said flat plate portions and said webs define outwardly open hollow spaces whose cross-section is constant or increasing in a direction perpendicular to the longitudinal axis of said cartridge body.

3. The dispensing cartridge of claim 2, wherein said hollow spaces have a rectangular cross-section, as viewed in a direction perpendicular to the longitudinal axis of said cartridge body.

4. The dispensing cartridge of claim 1, wherein said webs are disposed in parallel planes with respect to one another.

5. The dispensing cartridge of claim 1, wherein said first end of the cartridge body is a dispensing end of the dispensing cartridge.

6. The dispensing cartridge of claim 1, wherein said cartridge body comprises first and second elongated storage containers, and a volume ratio of the storage containers is different from 1:1.

7. The dispensing cartridge of claim 1, wherein said webs comprise at least two sets of webs, the webs of one of said sets extending generally perpendicular to the webs of the other one of said sets.

8. The dispensing cartridge of claim 1, wherein said first end of the cartridge body is opposite a dispensing end of the dispensing cartridge.

9. A dispensing cartridge having a reinforced retaining flange, comprising:

a cartridge body having first and second elongated storage containers, said storage containers having parallel longitudinal axes; and a retaining flange connected to a first end of said storage containers;

wherein said retaining flange includes first and second flat plate portions spaced apart from one another and disposed in generally parallel planes with respect to one another, and a plurality of webs extending between said flat plate portions.

10. The dispensing cartridge as set forth in claim 9, wherein said generally parallel planes of said flat plate portions are perpendicular to said longitudinal axes of said storage containers.

11. The dispensing cartridge as set forth in claim 10, wherein said plurality of webs includes a plurality of webs extending in a first direction and a plurality of webs extending in a second direction perpendicular to said first direction.

12. The dispensing cartridge as set forth in claim 10, wherein said flat plate portions include openings for receiving said elongated storage containers therethrough.

13. The dispensing cartridge as set forth in claim 12, wherein said flat plate portions and said webs are injection molded in a single integral piece.

14. The dispensing cartridge as set forth in claim 10, wherein said flat plate portions are generally rectangular-shaped.

* * * * *

UNITED STATES PATENT AND TRADEMARK OFFICE

CERTIFICATE OF CORRECTION

PATENT NO. : 5,330,079

DATED : July 19, 1994

INVENTOR(S) : Wilhelm A. Keller

It is certified that error appears in the above—identified patent and that said Letters Patent is hereby corrected as shown below:

On the title page, item [75] Inventor:
Inventor's first name is changed to read -- Wilhelm --.

Signed and Sealed this

Eleventh Day of October, 1994

Bruce Lehman

*Attest:*

BRUCE LEHMAN

*Attesting Officer*

*Commissioner of Patents and Trademarks*